United States Patent [19]

Rasmussen

[11] 3,989,861

[45] Nov. 2, 1976

[54] METHOD FOR COATING THE IMPACT SURFACE OF A GOLF CLUB HEAD

[76] Inventor: William P. Rasmussen, 1910 Coit Ave. NE., Grand Rapids, Mich. 49505

[22] Filed: Oct. 28, 1975

[21] Appl. No.: 625,860

Related U.S. Application Data

[62] Division of Ser. No. 457,125, April 1, 1974, abandoned.

[52] U.S. Cl. ..... 427/180; 51/295; 273/167 J; 273/DIG. 16; 427/156; 427/429

[51] Int. Cl.[2] ..... B05D 1/00

[58] Field of Search ..... 427/140, 154, 156, 180, 427/429, 142; 51/295, 298; 273/67 R, 77 R, 79, 167 R, 167 J, 173, DIG. 10, DIG. 16

[56] References Cited

UNITED STATES PATENTS

| | | | |
|---|---|---|---|
| 300,360 | 6/1884 | Gray | 273/72 R |
| 703,519 | 7/1902 | Becker | 273/76 |
| 2,908,502 | 10/1959 | Bradstreet et al. | 273/167 J |
| 3,246,629 | 4/1966 | Shelffo et al. | 273/167 J |
| 3,400,095 | 9/1968 | Kremer et al. | 273/DIG. 10 |
| 3,619,150 | 11/1971 | Rinker | 51/295 |
| 3,813,231 | 5/1974 | Gilbert et al. | 51/295 |

FOREIGN PATENTS OR APPLICATIONS

| | | | |
|---|---|---|---|
| 547,946 | 9/1942 | United Kingdom | 273/167 J |
| 1,062,796 | 3/1967 | United Kingdom | 273/167 J |

*Primary Examiner*—Thomas J. Herbert, Jr.
*Assistant Examiner*—Bruce H. Hess
*Attorney, Agent, or Firm*—Price, Heneveld, Huizenga & Cooper

[57] ABSTRACT

The impact surface of a golf club head is coated with a mixture of abrasive particles and a soluble adhesive. The mixture is applied as a liquid and after drying provides a non-permanent coating on the impact surface of the gold club head. The dried-on abrasive particles impart additional spin to a golf ball upon impact with the head.

9 Claims, No Drawings

METHOD FOR COATING THE IMPACT SURFACE OF A GOLF CLUB HEAD

CROSS-REFERENCE TO RELATED APPLICATION

This is a division of Ser. No. 457,125, filed Apr. 1, 1974, by Wiliam P. Rasmussen and entitled COATED GOLF CLUB HEAD AND METHOD AND COMPOSITION FOR COATING SAME, now abandoned.

BACKGROUND OF THE INVENTION

This invention relates to golf club heads and more particularly to a novel removable coating material which imparts added spin performance to the impact surface of the club head.

It is well known to coat a golf club head for added protection against wear. Such coatings are comprised of a long lasting protective material and flame sprayed or otherwise applied onto the club head during manufacture to prevent destruction or removal therefrom as much as possible. One particular prior art application teaches a club head coated with a nonbrittle material applied as a thin tenacious coating by a flame spraying technique. Such coatings are applied to the club head during the manufacturing process.

Unrelated to service-life, it is also well known that it is desirable to impart spin on the ball when using "irons" under certain conditions. Proper stroking of the ball to impart the desired spin and spin rate demands much skill and practice. Such skills are mastered by the professional but in varying degrees by the amateur golfer. While the prior art described above recognizes that the application of roughened granular coatings to the head surface readily imparts such a spin, such prior art teachings have only been recognized in connection with the development of a long-lasting coating designed solely to protect the club head. Further, such coatings are applied by the manufacturer and utilize fairly complicated techniques. Such coatings are thus uniform for the individual golfer regardless of skill.

Heretofore, the prior art has not suggested or taught a simple but effective spin control means which can be applied as a coating to the club head by the golfer himself. Further, none of the coating types of the prior art have been easily removable to permit trial and error techniques to arrive at the desired degree of roughness for the individual golfer.

A particular disadvantage of the prior art is the uniformity and permanence of coatings applied equally for all commercial clubs so that the range of performance is completely dependent on the skill of the golfer. Heretofore, there has been no suggestion or teaching of a coating material which allows the individual golfer to apply a coating of the material to his own clubs which will assist him in improving his skill at imparting spin on the ball. Thus, there is a need for a coating material which particularly enhances the ability of a golf club to impart spin on the ball regardless of the golfer's skill. Further, there is a need for such coating material which can be easily applied or removed and is economically attractive to all concerned.

SUMMARY OF THE INVENTION

In accordance with the present invention, the impact surface of a golf club head is coated with a mixture comprising abrasive particles and a soluble adhesive which is capable of being solubilized after drying. The mixture is applied as a liquid, allowed to dry, and after drying provides a non-permanent impact surface on the golf club head. The dried-on abrasive particles impart spin on a golf ball upon impact of the golf ball with the head.

The size range of abrasive particles giving best spin properties are preferably from about 46 to about 220 grit, more preferably from about 60 to about 120 grit, and most preferably from about 60 to about 90 grit. A preferred abrasive particles include silicon carbide particles while preferred adhesives include soluble acrylic polymers, particularly those plasticized and mixed in poly alkalene emulsion, such as polyethylene.

Particularly useful adhesives include those soluble in ammonia and other common household cleaning solvents.

DESCRIPTION OF THE PREFERRED EMBODIMENT

In the practice of the present invention, conventional golf club heads, particularly metallic in character, which have ball contacting impact surfaces thereon have these surfaces coated with a mixture comprising abrasive particles and a soluble adhesive which is capable of being solubilized after drying. The coating mixture is applied by the golfer himself as a liquid by a brush although other methods are envisioned such as dipping or an aerosol spray technique. After coating, the club impact surface is allowed to dry then the club is used in a conventional manner.

Various thicknesses of coatings may be employed as is desired by the individual player so as to impart varying degrees of spin giving capability to the impact surface of the golf club. Thus, depending on the skill of the individual golfer, a trial and error technique can be used to suit the individual needs.

As described above, the mixture is comprised of abrasive particles and a soluble adhesive which is non-permanent in nature. After substantial use of a club coated in accordance with the present invention, the impact surface of the golf club head must be recoated.

Abrasive particles giving the best spin properties are those most preferably in a size range of from about 46 to about 220 grit more preferably from about 60 to 120 grit, and most preferably from about 60 to about 90 grit. Particles less than 46 grit were found unsatisfactory since they do not provide sufficient roughness to develop good frictional contact with conventional golf balls, while particles greater than 220 mesh were found too large to adequately grip the ball.

Any commercially available abrasive or refractory quality silicon carbide is particularly well suited for use in the present invention. Among commercially available silicon carbides useful in the present invention are: "Carborundum" and "Carbofrax", manufactured by the Carborundum Company, Post Office Box 337, Niagara Falls, New York 14302; and Crystolon manufactured by Norton Company, Metals Division, 45 Industrial Place, Newton, Massachusetts.

Other suitable abrasives include sand, emory, powdered granite, pumice, boron carbide and aluminum oxide. While a variety of abrasives would work, it is preferred to use one which will not have a tendency to rust since during use, the golf club is subject to moisture.

Adhesives useful in the present invention are those substances capable of bonding abrasives to a golf club head in a non-permanent manner. Such adhesives may be inorganic and/or organic and include animal glues, resins and varnishes commonly used for so-called coated abrasives. As discussed, the adhesive must be capable of being solubilized after drying to facilitate its removal from the golf club head. Preferably, the dried on adhesive is soluble in ammonia or other commonly available household solvents.

Particularly useful adhesives include acrylic polymers that are preferably relatively fast drying in air, after being applied to the impact surface of a golf club head. These acrylic polymers may be solubilized upon drying so that they may be readily removed from the surface upon which they have been coated.

Useful acrylic polymers include polymers or copolymers of acrylic acid, methacrylic acid, esters of these acids, or acrylonitriles. To facilitate dispersion of the silicon carbide particles in the acrylic polymer, the polymer is preferably plasticized and mixed in a polyalkalene emulsion, such as polyethylene.

Because of the availability of ammonias as a common household solvent, particularly useful acrylic polymers include those soluble in ammonia after drying. One such useful commercially available plasticized acrylic polymer in polyethylene emulsion identified as R299 is manufactured by F. J. Thomas Company, 1128 Pannell, N. W., Grand Rapids, Michigan 49501.

Mixing ratios of the abrasive such as silicon carbide to adhesive, such as plasticized polymer suspended as a polyalkaline emulsion, are readily determinable upon experimentation by one skilled in the art. Mixtures in the range of from about three parts by volume silicon carbide to two parts by volume acrylic, to mixtures in the range of about one part by volume silicon carbide to about three parts by volume acrylic are suitable. The most preferred mixture ratio being about one part by volume silicon carbide to about one part by volume acrylic polymer. Economically it is desirable to minimize the amount of abrasive in the mixture. Accordingly, from an economic standpoint, mixtures of one part abrasive to two parts adhesive are particularly useful.

In order to facilitate understanding of the present invention the following examples are offered:

EXAMPLE I

A golf club head has its ball contacting impact surface coated by brushing thereon a mixture comprising silicon carbide particles and soluble acrylic polymer. The mixture is in a liquid form and is a one to one ratio by volume mixture of 60–120 grit Carborundum particles manufactured by the Carborundum Company, Niagara Falls, New York and a soluble acrylic polymer, R299 manufactured by F. J. Thomas Company, Grand Rapids, Michigan.

The mixture is applied from a 3 oz. paint can which has the bottom half filled with Carborundum particles and the top half filled with R299. A brush attached to the top of the paint can extends into the Carborundum and is drawn through the polymer when the mixture is being applied to the golf club head. As the brush is drawn through the stratified "Carborundum" particles and polymer, sufficient particles and polymers are retained so as to provide a mixing of the two when they are applied to the golf club head. Thus, extensive mixing of the contents in the can is not necessary in order to apply the mixture. Sufficient mixture is brushed on to coat the impact surface with a coating thickness of about 5 mils.

The club head is allowed to dry for about 2 hours and a conventional round of golf is played utilizing the golf club which shows much improved spin giving properties. Drying time varies of course depending upon temperature, humidity, etc. A solution of household ammonia is used to remove the coating from the surface of the club head.

EXAMPLE II

A golf club head is coated as in Example I, allowed to dry overnight, and a conventional round of golf played. Another coating of the mixture of Example I is brushed over the initial coating to change the average thickness of the coating on the impact surface from about 5 mils to about 10 mils. After allowing the coating to dry for about 2 hours, another round of golf is played wherein it is found that the spin imparted on the golf balls hit by the coated surface is even significantly greater than before the second coating.

The embodiments of the invention in which an exclusive property or privilege is claimed are defined as follows.

1. A method of coating the impact surface of a golf club with a nonpermanent coating particularly suited to impart spin to a golf ball upon impact with the head, the method comprising: forming a mixture comprising abrasive particles and a soluble adhesive which is capable of being solubilized after drying in a common household solvent; applying the mixture as a liquid to the impact surface of a golf club head; and allowing the mixture to dry; thereafter, following use of the club, removing the coating with a common household solvent and reapplying the said mixture and allowing it to dry in preparation for reuse of the golf club.

2. The method of claim 1 in which said soluble adhesive comprises plasticized acrylic polymer suspended in a polyalkaline emulsion.

3. The method of claim 1 wherein said abrasive particles include silicon carbide particles and said soluble adhesive includes a soluble acrylic polymer.

4. The method of claim 3 wherein said soluble acrylic polymer is plasticized and suspended in a polyalkalene emulsion.

5. The method of claim 4 wherein said polyalkalene emulsion is polyethylene.

6. The method of claim 1 wherein said abrasive particles are in the size range of from about 46 to about 220 grit.

7. The method of claim 6 wherein said abrasive particles are in a size range of from about 60 to about 120 grit.

8. The method of claim 7 wherein said abrasive particles are in a size range of from about 60 to about 90 grit.

9. The method of claim 3 wherein the mixture is formed in a container as a strata of silicon carbide particles below soluble acrylic polymer and wherein a brush is extended into said mixture through said polymer and into said particles and withdrawn and said particles and polymer are formed into a mixture while on said brush and while being applied to said golf club head.

* * * * *